United States Patent [19]

Spissinger

[11] Patent Number: 4,651,061

[45] Date of Patent: Mar. 17, 1987

[54] APPARATUS TO FACILITATE LENGTHENING THE LIFE OF INCANDESCENT LAMPS

[76] Inventor: Friedrich H. Spissinger, 3343 West Broadway, Vancouver, British Columbia, Canada, V6R 2B1

[21] Appl. No.: 654,442

[22] Filed: Sep. 25, 1984

[51] Int. Cl.[4] ..... H05B 37/00; H05B 39/00; H05B 41/14

[52] U.S. Cl. ..... 315/200 R; 315/205; 315/DIG. 4; 315/171

[58] Field of Search ..... 315/200 R, 205, 208, 315/50, 52, 53, 71, 101, 102, 171, DIG. 4

[56] References Cited

U.S. PATENT DOCUMENTS

| | | | |
|---|---|---|---|
| 3,198,984 | 8/1965 | Franke | 315/200 R X |
| 3,207,949 | 9/1965 | Rice | 315/200 R X |
| 4,004,184 | 1/1977 | Ott | 315/200 R X |
| 4,112,336 | 9/1978 | Rios | 315/71 X |
| 4,114,477 | 3/1979 | Eaton | 315/208 X |
| 4,342,947 | 8/1982 | Bloyd | 315/200 R X |

*Primary Examiner*—Saxfield Chatmon

*Attorney, Agent, or Firm*—Townsend and Townsend

[57] ABSTRACT

An energizing circuit for an incandescent light bulb includes two rectifiers with their outputs connected in parallel across the bulb. One rectifier has a low voltage output to keep the bulb filament warm while the other rectifier, which is energized by closing a switch, has a higher voltage which causes the bulb to emit high intensity light.

3 Claims, 3 Drawing Figures

APPARATUS TO FACILITATE LENGTHENING THE LIFE OF INCANDESCENT LAMPS

FIELD OF THE INVENTION

This invention relates to an energizing circuit for an incandescent bulb. This invention finds application wherever incandescent bulbs are used but was developed originally for photographic enlargers. The following discussion therefore tends to emphasize the enlarger aspect.

DESCRIPTION OF THE PRIOR ART

Photographic enlargers have a bulb which is normally energized by low voltage AC, e.g. 24 VAC, to provide high intensity light for exposing photosensitive paper or plates. A problem with enlarger bulbs is that they have quite a short life. It is believed that there are at least three principal factors causing this short life, viz. start-up surge or peak in rush current which can be up to 20 times the operating current for the first one third of a second, vibration due to the use of alternating current and stress caused by heating and cooling when the bulb is turned on and off.

It is known that the life of an incandescent bulb can be increased by putting a rectifier in series with it because the resulting half-wave DC current is less than the current supplied by the normal AC mains, typically 120 VAC. See, for example, U.S. Pat. No. 3,823,339 of Borneman, et al, issued July 9, 1974, and U.S. Pat. No. 4,229,680 of Berlin, et al, issued Oct. 21, 1980. Of course the light output is reduced.

SUMMARY OF THE INVENTION

The present invention uses a full-wave rectifier to energize an incandescent bulb so that there need be no less light output than with AC; however, vibrations of the filament due to magnetic flux reversals are eliminated thus contributing to longer bulb life. The invention also uses a second full-wave rectifier which provides sufficient current to always keep the filament warm, thus substantially reducing the peak in rush current and thermal shock effects normally occurring when current is suddenly applied to a cold filament.

Thus, in accordance with a broad aspect of the invention, there is provided an energizing circuit for an incandescent bulb comprising a transformer having a primary winding connectable to an AC mains source and first and second secondary windings for producing first and second voltages, said first and second secondary windings being connected to inputs of first and second full-wave rectifier means having outputs connected in parallel across said bulb, said first voltage being sufficient to fully illuminate said bulb and said second voltage being sufficient to maintain said bulb warm but with little or no light output, a first switch being connected between said first secondary winding and said first rectifier means whereby, when said first switch is open, said bulb is energized solely by said second voltage.

BRIEF DESCRIPTION OF THE DRAWINGS

In the drawings, which illustrate the invention.

DESCRIPTION OF THE PREFERRED EMBODIMENT

Figure 1:
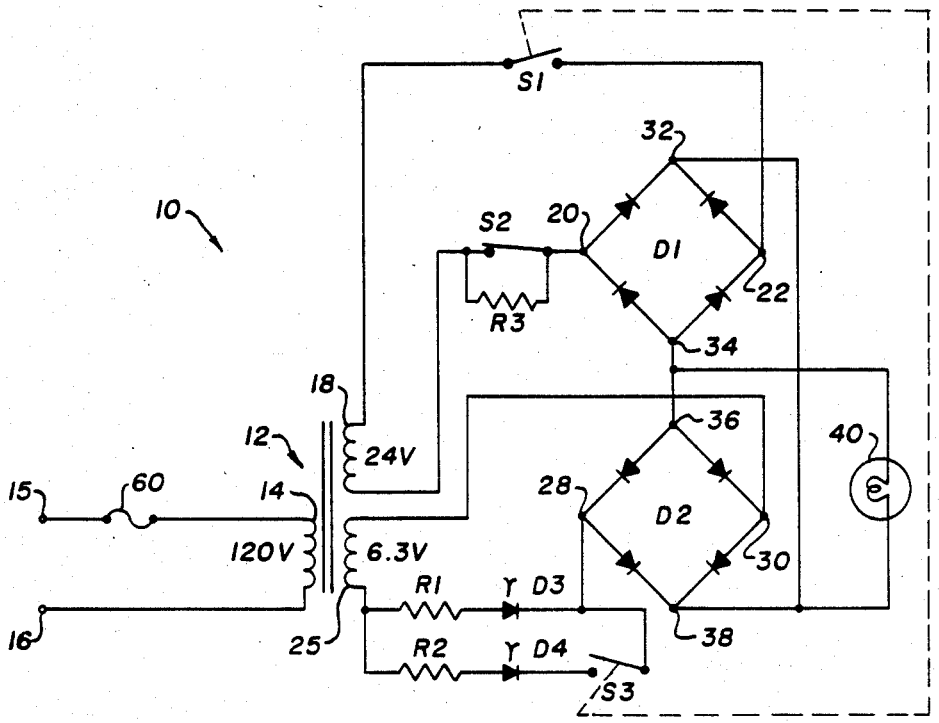
FIG. 1 is a schematic diagram of an energizing circuit for an incandescent bulb in accordance with the invention and as applied to an enlarger bulb.

Referring to FIG. 1, an energizing circuit for an enlarger bulb in accordance with the invention is generally indicated at 10. The circuit includes a transformer 12 having a primary winding 14 connected to an AC mains source (not shown) via terminals 15 and 16. Typically, the AC mains source is 120 VAC although any other suitable AC voltage source could be used. The transformer 12 has a first secondary winding 18 for producing a first voltage of, in this embodiment, 24 VAC. The secondary winding 18 is connected to the input 20, 22 of a first full-wave rectifier D1. A second secondary winding 25 is connected to the input 28, 30 of a second full-wave rectifier D2. The output 32, 34 of rectifier D1 is connected in parallel with the output 36, 38 of rectifier D2 and these parallel outputs are connected across the enlarger bulb 40. The winding 25 produces a voltage of about 6.3 VAC in this embodiment.

Before describing the operation of the circuit, the remaining components will be briefly described.

A first switch S1 is connected between the upper end of winding 18 and input terminal 22 of rectifier D1. A switch S2, in parallel with a resistor R3, is connected between the lower end of winding 18 and input terminal 20 of rectifier D1.

A light emitting diode D3 (green) is connected in series with a resistor R1 between the lower end of winding 25 and input terminal 28 of rectifier D2. Also connected between these points, in parallel with R1, D3, is a series combination comprising a resistor R2, light emitting diode D4 (red) and a switch S3.

Turning now to the operation of the circuit, it can be seen that with the switches S1–S3 in the positions shown no current is supplied to rectifier D1 but a low-level current is supplied from winding 25 to rectifier D2, which thus provides a low-level DC current to lamp 40 via its output terminals 36, 38. This low-level current keeps the bulb filament (and thus the bulb 40 itself) warm so that when it is subsequently fully energized it will not be subjected to a large thermal shock as would be the case if the bulb were cold. At this time, LED D3 is illuminated to indicate that warming current is flowing to the bulb 40.

When it is desired to use the enlarger to make an exposure, the switch S1 is closed, thus energizing rectifier D1 which provides to lamp 40 a sufficiently high-level DC current to illuminate it a nominal "full power" level. Although not shown in the drawing to avoid cluttering it, switch S3 is ganged to switch S1 so that they open and close together. Obviously, closure of switch S3 causes LED D4 (red) to illuminate in addition to LED D3 (green), thus indicating that power is being sent to bulb 40 to illuminate it.

Opening switch S2 connects a resistor R3 in series with winding 18 and rectifier D1 to reduce the current when less than "full power" is required from lamp 40, i.e. for a low power output.

A fuse 60 may be incorporated in series with winding 14 for safety reasons.

The circuit according to the invention can extend the life of an enlarger bulb up to 8 times or more on low power and up to 4 times or more on high power, as compared to normal bulb energizing circuits. Furthermore, the color of the light emitted by the bulb is more stable especially when a series of high quality colour matched prints as transparencies have to be made. Bulbs and their reflectors and dichloric filters often change colour until the eighth print, when they rush their full operating temperature. The bulb and its reflector, when kept hot, act as a projecting heat element that keeps the dichloric filter hot. There is thus much less colour change when printing at full power.

Although the stand-by heading circuit (winding 25, rectifier D2) is always connected, it has been found that, after switch S1 is opened, the bulb cools slowly to the stand-by level and yet fast enough to not affect print quality.

Figure 2:
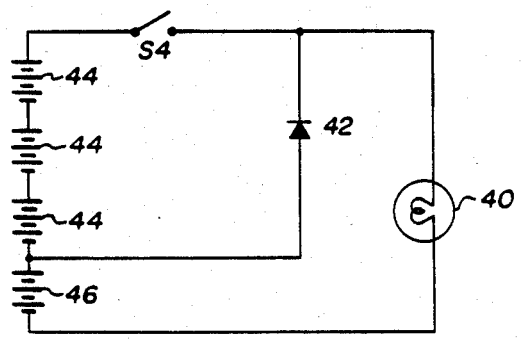
FIG. 2 is a detail of a modification of the invention.
Figure 3:
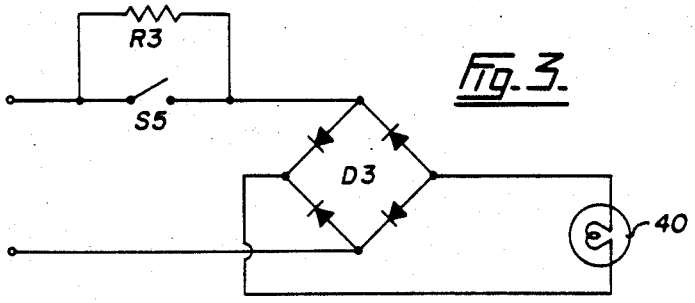
FIG. 3 is a detail of a further modification.

FIGS. 2 and 3 illustrate variations of the circuit of the present invention. FIG. 2 illustrates a variation useful in areas where power fluctuations in the electrical supply system are common. For example in India power fluctuations can be as great as 20%. However a small surge of 2 or 3% can cause unsatisfactory results in colour printing. Thus in the embodiment of FIG. 2 the lamp 40 is run off a plurality of six volt batteries, 44 and 46. Switch S4 isolates the lamp 40 from the power supply and diode 42 isolates 6 volts from one of the batteries, 46, for preheat power.

A recharger (not shown) is used to keep the batteries charged at all times.

An advantage of this embodiment is that the cells 44 and 46 produce unvarying DC rather than the pulsating DC output from the bridge rectifier. Furthermore the batteries in the charger are all that are required to power the lamps. Various kinds of voltage stabilizers, which are costly and unreliable, may be eliminated from the prior art systems.

The embodiment illustrated in FIG. 3 finds application in units manufactured with the circuit of FIG. 1 incorporated into the power supply. Resistor R3 is placed across switch S5 for the lamp 40 in the enlarger head. A bridge rectifier D3 is placed in line. With switch S5 open preheat is provided by the power through the resistor R3—which will have different values depending on the application—into the bridge D3 and to the lamp 40. When a print is desired the switch is closed, shorting out the resistor R3 and giving full power to the rectifier D3 and lamp 40.

A minor disadvantage of this latter system is that the resistor across the switch will become warm from the electricity wasted while the switch is open.

A further change to increase bulb life is to use a "zero crossing detector". By using this device, the bulbs will be switched on only at zero voltage further reducing the initial startup stress on the filament.

Normally, the bulb is a quartz halogen lamp and, with the present invention, the filament does not constantly get re-fused which re-fusing changes the infrared and ultraviolet spectrum of the lamp which color analyzers or translators cannot read but which changes the color and density of a print.

As indicated the invention finds application in preserving incandescent bulbs but is of particular application for bulbs emitting high intensity light, especially when the lights are switched on and off frequently.

The circuit of the invention will extend the life of traffic lights many-fold providing savings not only in labour costs, but helping to prevent traffic accidents, especially during heavy traffic when it is next to impossible to change a broken lamp.

An additional circuit can be added to the circuit of the invention to introduce a dawn photo sensor that reduces through a dimmer switch the brightness of the traffic lights by approximately forty percent. Traffic lights are made to be seen in bright sunlight and it is not necessary to have the same brightness at night. It is also safer to have traffic lights at a reduced brightness as it is then easier to judge the distance of intersections. The savings in energy worldwide are obvious and, of course, by reducing the voltage by forty percent traffic lightbulbs using the circuit at this reduced voltage at night should last in excess of twenty times longer.

A further application of the invention is with portable high intensity television, movie, photographic and construction lights. It is well known that in movie and television studios the lighting technicians start up the stage lights with a rheostat, slowly increasing their intensity to save the lamps. This is not possible with portable lighting equipment. An additional part of the invention is to add a unit to every portable light with a Nicad battery. The circuit can be used for portable lighting so the lamps will glow when they are plugged in on direct current. The purpose of the Nicad battery is to provide power for approximately three minutes when these portable lights are turned off or unplugged. The purpose of providing this power is to keep the bulb glowing which will keep the filament in a flexible rubber-like state. When the lighting technicians close the barn doors and lower the tripods the hard hammer-like metal knocks will not break the glass, filament, or socket. So the battery life will not be shortened, a sensing circuit will disconnect the battery from the bulb when the voltage is lowered close to the exhaustion point. When the portable lights are plugged in, not only will the filament glow but a charging circuit will bring the battery back to full charge.

The circuit of the invention may be installed on search lights of any type to keep these high intensity lamps glowing at all times when a motor vehicle, ship, or aircraft is in operation. The most extreme case would be a search light on a ship, etc. in sub-zero conditions where the wind-chill factor increases cooling effects many times. Search lights are turned on in emergency situations and it is impossible to change a lamp when the lamp housing is covered in ice.

The above considerations apply, for example, to aircraft landing lights and maritime beacons.

This invention also finds application in incandescent bulbs used in, for example, cars. Such lights as parking lights, signal lights and even head lights are subject to corrosion because they are subjected to extreme weather conditions. If such bulbs are kept warm then the corrosion problem is reduced as water will not dwell but will evaporate.

It is intended that all matters contained in the foregoing description or shown in the accompanying drawing shall be interpreted as illustrative rather than in a limiting sense.

I claim:

1. An energizing circuit for an incandescent bulb comprising a transformer having a primary winding connectable to an AC mains source and first and second secondary windings for producing first and second voltages, said first secondary winding being connected to an input of a first full-wave rectifier means and said second secondary winding being connected to an input of a second full-wave rectifier means, said full-wave rectifier means having outputs connected in parallel across said bulb, said first voltage being sufficient to fully illuminate said bulb and said second voltage being sufficient to maintain said bulb warm but with little or no light output, a first switch being connected between said first secondary winding and said first rectifier means whereby, when said first switch is open, said bulb is energized solely by said second voltage.

2. A circuit as claimed in claim 1 and further comprising a parallel combination of a resistor and a second switch connected between said first secondary winding and said first rectifier means whereby when said second switch is closed said bulb is energized by said first voltage whereas, when said second switch is open, said bulb is energized at a third voltage which is less than said first voltage but more than said second voltage.

3. A circuit as claimed in claim 2 and further comprising a first LED connected between said second secondary winding and said second rectifier to provide an indication when said bulb is being energized by said second voltage and a second LED connected in series with a third switch between said second secondary winding and said second rectifier, said third switch being ganged with said first switch whereby, when said first and third switches are closed, said second LED is illuminated to indicate that said bulb is being energized by said first voltage.

* * * * *